US011751700B2

(12) United States Patent
Jain et al.

(10) Patent No.: US 11,751,700 B2
(45) Date of Patent: Sep. 12, 2023

(54) COOLER FOR BEVERAGE AND FOOD PRODUCTS

(71) Applicant: PepsiCo, Inc., Purchase, NY (US)

(72) Inventors: Sandeep Jain, Gurgaon (IN); Gurmeet Singh Bhutani, Gurgaon (IN)

(73) Assignee: PepsiCo, Inc., Purchase, NY (US)

( * ) Notice: Subject to any disclaimer, the term of this patent is extended or adjusted under 35 U.S.C. 154(b) by 235 days.

(21) Appl. No.: 16/552,486

(22) Filed: Aug. 27, 2019

(65) Prior Publication Data

US 2020/0069077 A1 Mar. 5, 2020

(30) Foreign Application Priority Data

Aug. 29, 2018 (IN) ..... 201841032286

(51) Int. Cl.

| | |
|---|---|
| ***A47F 3/02*** | (2006.01) |
| ***A47F 3/06*** | (2006.01) |
| ***A47F 3/04*** | (2006.01) |

(52) U.S. Cl.

CPC ..... *A47F 3/02* (2013.01); *A47F 3/0434* (2013.01); *A47F 3/06* (2013.01)

(58) Field of Classification Search

CPC ..... A47F 3/02; A47F 3/0434; A47F 3/06

USPC ..... 312/116, 280, 408; 62/246

See application file for complete search history.

(56) References Cited

U.S. PATENT DOCUMENTS

| | | | | |
|---|---|---|---|---|
| 1,803,774 | A * | 5/1931 | Schmidt | A47F 3/02 312/42 |
| 2,099,653 | A * | 11/1937 | Kneisley | F25D 25/024 108/137 |
| 2,341,183 | A | 2/1944 | Loewy | |
| 3,859,932 | A | 1/1975 | Armstrong et al. | |

(Continued)

FOREIGN PATENT DOCUMENTS

| | | |
|---|---|---|
| EP | 2944229 A1 | 11/2015 |
| WO | 2011/123487 A1 | 10/2011 |
| WO | WO 2016/053160 A1 | 4/2016 |

OTHER PUBLICATIONS

International Search Report and the Written Opinion of the International Searching Authority in PCT/US2019/048261, dated Nov. 19, 2019, 17 pages.

(Continued)

*Primary Examiner* — James O Hansen

(74) *Attorney, Agent, or Firm* — Sterne, Kessler, Goldstein & Fox P.L.L.C.

(57) ABSTRACT

Coolers for dispensing products, such as beverages, having multiple doors for accessing a single product compartment. A cooler may include a housing defining a product compartment; a top door coupled to a top surface of the housing at a hinge, the top door comprising a curved transparent panel; a vertical door coupled to a vertical front surface of the housing; a collapsible shelf disposed in the product compartment that is configured to move between an extended position and a retracted position; and a lower shelf disposed below the collapsible shelf in the product compart- (Continued)

ment. A product disposed on the collapsible shelf may be accessible through the top door when the collapsible shelf is in the extended position and a product disposed on the lower shelf may be accessible through the top door when the collapsible shelf is in the retracted position.

16 Claims, 15 Drawing Sheets

(56) References Cited

U.S. PATENT DOCUMENTS 4,138,175 A * 2/1979 Tattershall ..... F25D 25/02 211/187
4,528,825 A * 7/1985 Khan ..... F25D 25/02 312/313
4,949,554 A * 8/1990 Branz ..... A47F 3/0404 62/248
5,639,149 A * 6/1997 Grassmuck ..... A47F 3/007 277/645
6,351,964 B1 3/2002 Brancheau et al.
6,530,631 B2 * 3/2003 Brown ..... A47B 63/04 108/9
8,033,129 B2 * 10/2011 Koike ..... A47F 3/0404 62/264
D679,735 S 4/2013 Roekens
8,840,205 B2 * 9/2014 Chellappan ..... F25D 23/067 108/93
9,821,888 B1 11/2017 Gulino et al.
2006/0125362 A1 * 6/2006 Kim ..... F25D 25/024 312/408
2007/0176528 A1 * 8/2007 Lee ..... F25D 25/02 312/408
2007/0228909 A1 10/2007 Hwang et al.
2008/0083301 A1 4/2008 Messina
2010/0180616 A1 7/2010 Linder et al.
2011/0239675 A1 10/2011 Roekens
2015/0219389 A1 8/2015 Schaefer et al.
2016/0174736 A1 * 6/2016 Sergio ..... A47F 3/007 312/116
2016/0187054 A1 * 6/2016 Park ..... F25D 25/027 312/408

OTHER PUBLICATIONS

Extended European Search Report in Application No. EP 19856329.8, dated Apr. 19, 2022 (8 pages).

* cited by examiner

COOLER FOR BEVERAGE AND FOOD PRODUCTS

CROSS-REFERENCE TO RELATED APPLICATION

This application claims priority to Indian Patent Application No. 201841032286, filed Aug. 29, 2018, entitled "COOLER FOR BEVERAGE AND FOOD PRODUCTS," which is incorporated herein in its entirety by reference thereto.

FIELD

The described embodiments generally relate to coolers. In particular, embodiments relate to coolers having a top door and a vertical door for dispensing beverage and/or food products.

BACKGROUND

Often perishable food and beverage items require a controlled cooled storage environment. Consequently, many storage units have been developed that contain a mechanism that controls the environment of an enclosed space. Most of these units have some kind of access portal, like a door, or slidable window that provides access to the enclosed, interior space of the storage unit for retrieving products from the cooling unit. However, these coolers often provide limited visibility of the products contained in the cooler and limited access to the products through a single access portal such that consumers cannot easily identify and retrieve a desired product.

BRIEF SUMMARY OF THE INVENTION

Some embodiments are directed to a cooler for dispensing products, comprising: a housing defining a product compartment; a top door coupled to a top surface of the housing at a hinge, the top door comprising a curved transparent panel; a vertical door coupled to a vertical front surface of the housing; a collapsible shelf disposed in the product compartment wherein the collapsible shelf is configured to move between an extended position and a retracted position; and a lower shelf disposed below the collapsible shelf in the product compartment. The collapsible shelf may be configured such that a product disposed on the collapsible shelf is accessible through the top door when the collapsible shelf is in the extended position and a product disposed on the lower shelf is accessible through the top door when the collapsible shelf is in the retracted position.

Some embodiments are directed to a cooler for dispensing products having: a frame; a housing disposed around the frame, the housing defining a single product compartment and comprising a top opening in a top surface of the housing and a vertical opening in a front surface of the housing; a top door disposed over the top opening, the top door comprising a horizontal surface and a curved transparent panel, the top door coupled to the housing at a hinge such that the top door is configured to move between an open position allowing access to the product compartment and a closed position; a vertical door disposed over the vertical opening configured to move between an open position allowing access to the product compartment and a closed position; and an uppermost shelf comprising an upper step and a lower step, wherein the lower step is configured to move between an extended position and a retracted position in which the lower step is disposed directly below the upper step; and a lower shelf disposed below the collapsible shelf.

Some embodiments are directed to a cooler for dispensing products having a frame; a housing disposed around the frame, the housing defining a product compartment and comprising a top opening in a top surface of the housing and a vertical opening in a front face of the housing; a top door comprising a transparent panel disposed over the top opening; a vertical door disposed over the vertical opening; and an uppermost shelf comprising an upper step and a lower step, wherein the lower step is configured to move between an extended position and a retracted position in which the lower step is disposed below the upper step; and a lower shelf disposed below the collapsible shelf configured to have a first row of products and a second row of products disposed on the lower shelf. The top door and the uppermost shelf are configured to facilitate increased air flow within the product compartment.

In any of the various embodiments discussed herein, a hinge coupled to the cooler housing and the cooler top door may be a gas spring hinge. The cooler top door may include a curved transparent panel that is a multi-pane glass panel. The curved transparent panel may extend from the hinge to the front edge of the cooler housing. The curved transparent panel may extend from a front most edge of the cooler housing to a rearmost edge of the housing. The cooler housing may include a top rear portion extending from a rear edge of the cooler toward the vertical door, and the hinge may be disposed frontward of the top rear portion of the top door such that the hinge is disposed over a row of products disposed on the collapsible shelf. The vertical door may include a transparent panel. The collapsible shelf may comprise an upper step and a lower step. The collapsible shelf may be configured to support a product in an extended position and a retracted position. The vertical door may comprise a transparent panel, and the vertical door transparent panel and the curved transparent panel may be configured such that a product disposed on the upper step, a product disposed on the lower step, and a product disposed on the lower shelf are visible to a consumer positioned in front of the cooler. The top surface of the housing may comprise a horizontal surface substantially perpendicular to the vertical front surface of the housing.

BRIEF DESCRIPTION OF THE DRAWINGS/FIGURES

DETAILED DESCRIPTION OF THE INVENTION

Figure 1:
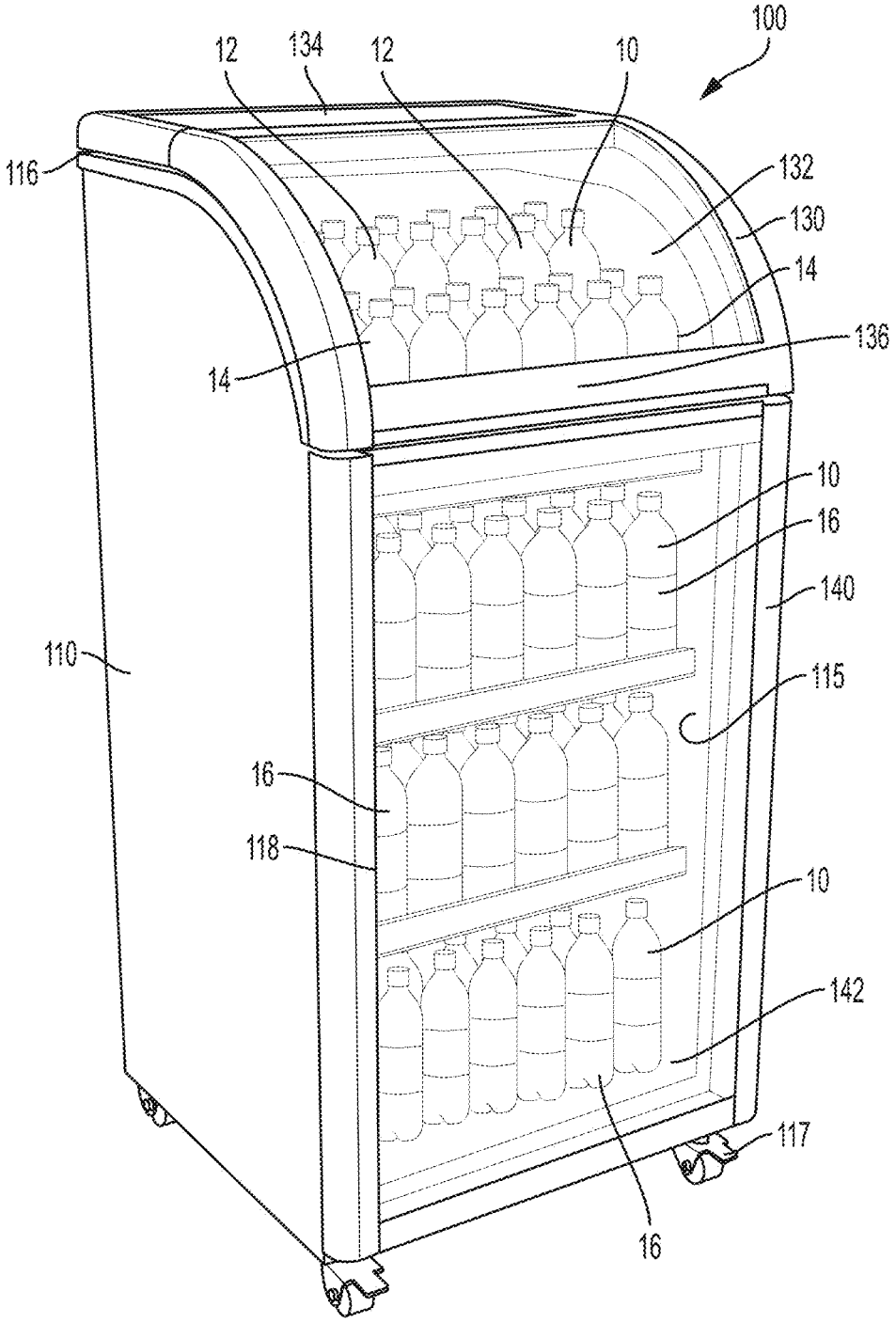
FIG. 1 is a schematic view of a cooler according to embodiments.

The present invention(s) will now be described in detail with reference to embodiments thereof as illustrated in the accompanying drawings. References to "one embodiment", "an embodiment", "an exemplary embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

Embodiments include a cooler 100 for storing and dispensing a plurality of products 10. The products 10 may be stored in a product compartment 114 that may be accessed by a consumer through a top door 130 and a vertical door 140. Cooler 100 includes a collapsible shelf 120 and at least one lower shelf 126 disposed below collapsible shelf 120. In embodiments, cooler 100 is configured to facilitate increased air flow within product compartment 114. In embodiments, top door 130 and vertical door 140 are configured to provide increased visibility of products 10 disposed in product compartment 114.

The products 10 stored in product compartment 114 may include any desired perishable or non-perishable product. In one embodiment, products 10 include individually packaged products, such as, bottles, cans, or bags. Products 10 may include, but are not limited to, soft drinks, water, carbonated water, dairy beverages, juices, alcoholic beverages, sports drinks, smoothies, coffee beverages, tea beverages, and milkshakes. Products 10 may also include snack foods.

Figure 2:
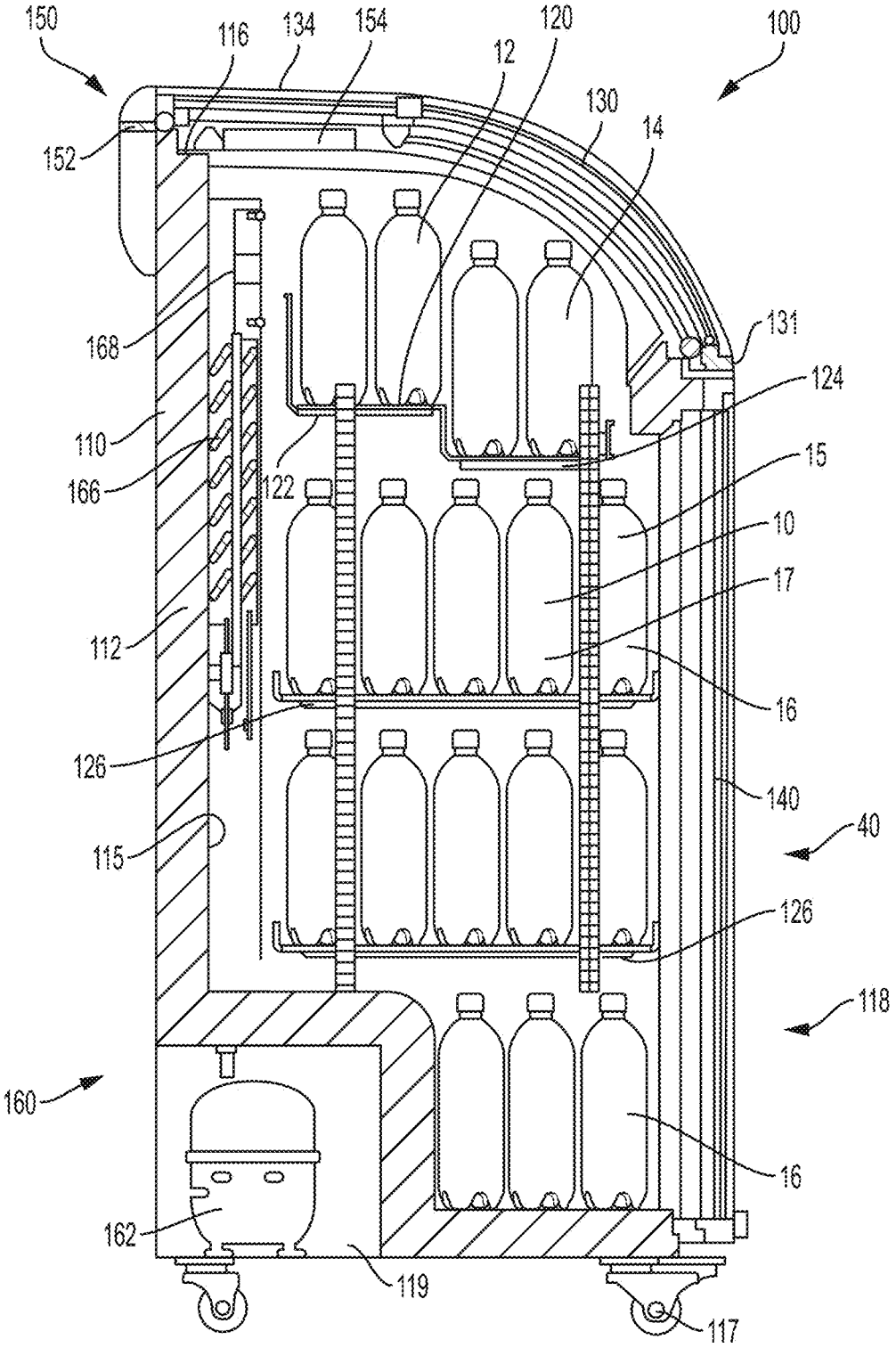
FIG. 2 is a cross-sectional side view of a cooler with a top lid in a closed configuration according to embodiments.

As shown, for example, in FIGS. 1 and 2, cooler 100 includes a housing 110 that forms an outer casing for the cooler. An interior of housing 110, including interior walls 115, defines product compartment 114. In an embodiment, product compartment 114 is a single, unitary product compartment. In this manner, product compartment 114 does not include a separation wall and access to product compartment 114 provides access to all products 10 stored in cooler 100. Housing 110 may be made of plastic or other suitable material that may provide insulation for the product compartment 114. In embodiments, cooler 100 includes a frame 112 for providing support for cooler 100, and housing 110 is disposed around frame 112. Cooler 100 may include wheels 117 such that it may be easily moved by a user. The cooler may have any desired size and shape.

Top door 130 is coupled to a top surface 116 of housing 110 by a hinge assembly 150 and is configured to cover an upper opening 30 in cooler 100. A handle 136 disposed on top door 130 at a front edge 131, for example, may be operated by a user to move top door 130 into an open position and gain access to product compartment 114. In some embodiments, hinge assembly 150 may be coupled to a motor and controller such that top door 130 may be automatically opened and/or closed without manual operation.

Figure 8:
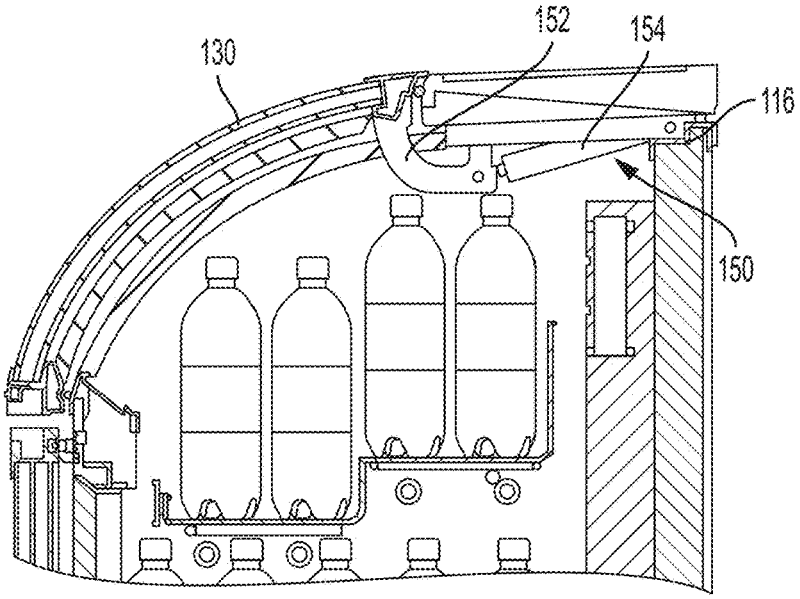
FIG. 8 is a partial cross-sectional perspective view of a cooler according to embodiments.
Figure 9:
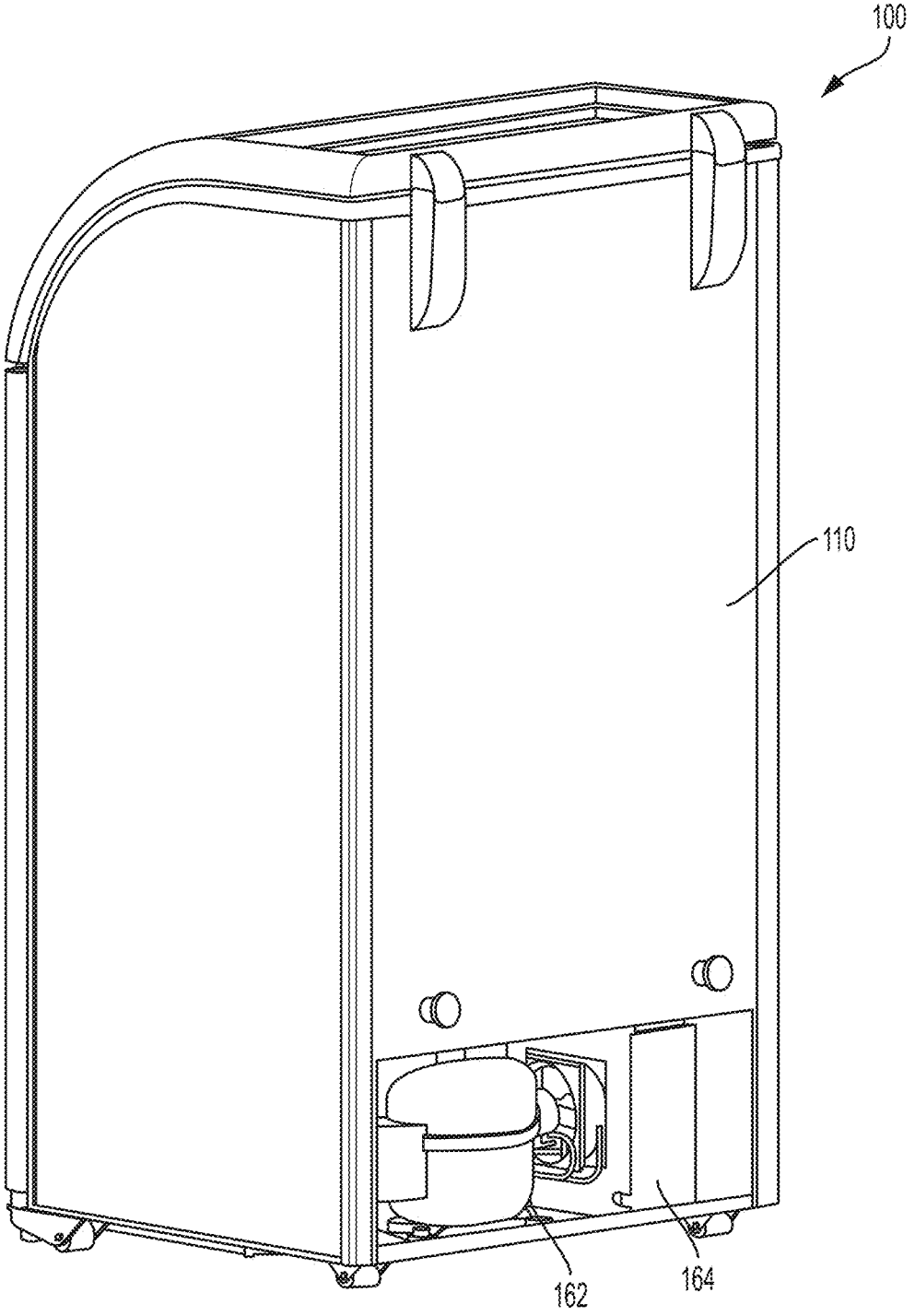
FIG. 9 is a rear perspective view of a cooler according to embodiments.

In one embodiment, hinge assembly 150 comprises a gas spring hinge including a hinge 152 coupled to housing 110 and top door 130, and a pneumatic cylinder 154 coupled to housing 110 and top door 130. In this manner, the pneumatic cylinder 154 of hinge assembly 150 is configured to facilitate easy opening of top door 130 and controlled, slow closing of top door 130. In one embodiment, hinge assembly 150 is coupled to top door 130 at a rear panel 134. In one embodiment, hinge assembly 150 is disposed entirely within product compartment 114 when top door 130 is in a closed configuration, as shown, for example, in FIG. 8.

In embodiments, as shown, for example, in FIGS. 1-4, top door 130 is curved. In embodiments, as shown, for example, in FIG. 1, top door 130 includes a panel 132 that is a curved transparent panel 132. In an embodiment, transparent panel 132 is a multi-pane glass panel. In this manner, transparent panel 132 may provide reduced heat loss from cooler 100. In embodiments, top door 130 extends from a front most edge 111 of housing 110 to a rearmost edge 113 of housing 110, as shown, for example, in FIG. 3. In some embodiments, all or a portion of panel 132 may be opaque. As compared with a chest cooler, for example, cooler 100 having a curved top door 130 may allow for a smaller product compartment 114 to be used without having reduced product storage.

Figure 3:
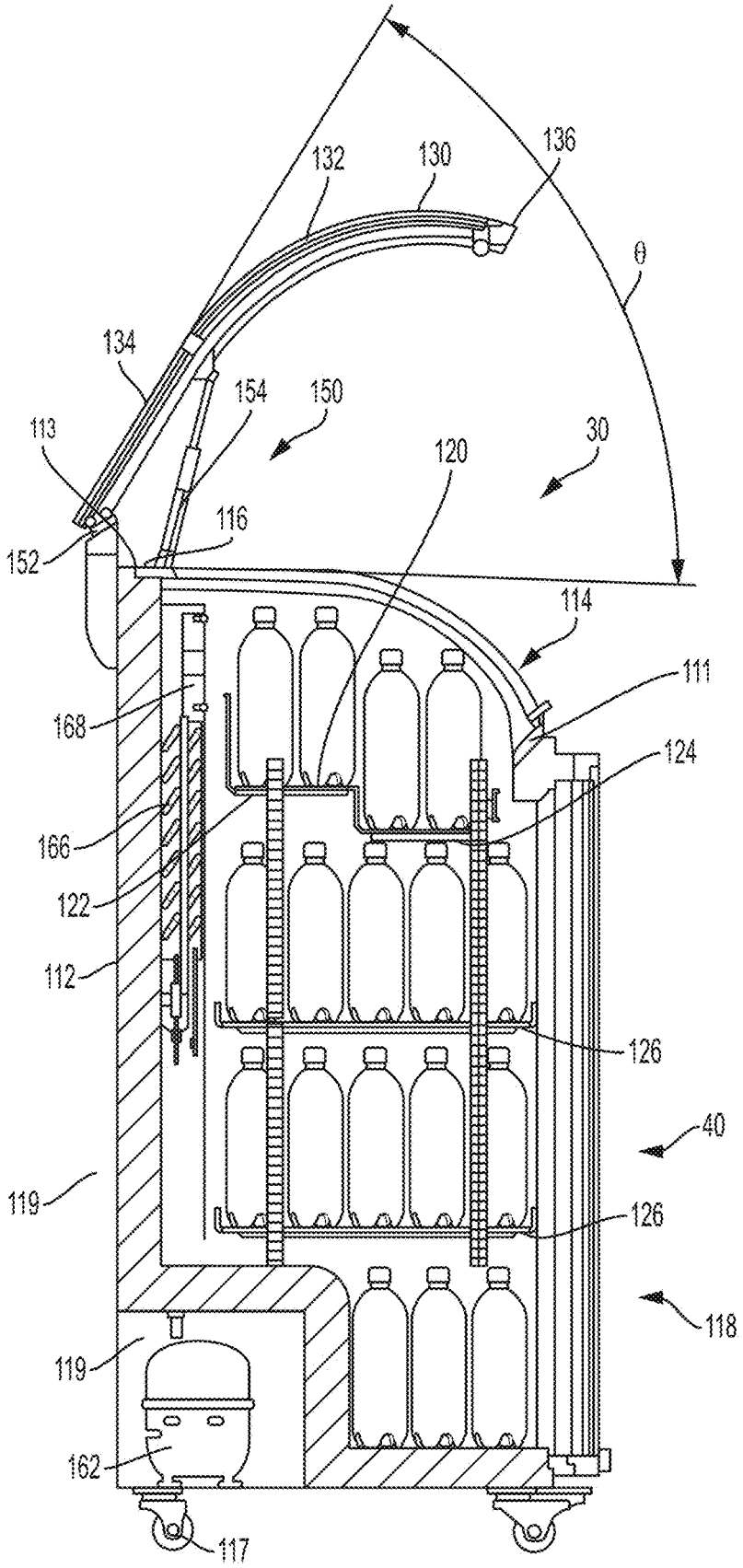
FIG. 3 is a cross-sectional side view of a cooler with a top lid in an open configuration according to embodiments.

In one embodiment, top door 130 includes rear panel 134 disposed at a rear portion of top door 130. Rear panel 134 may be disposed horizontally such that it is substantially parallel to the ground, as shown, for example, in FIG. 2. In one embodiment, transparent panel 132 extends from a front most edge 111 of housing 110 to rear panel 134 and rear panel 134 extends from transparent panel 132 to rearmost edge 113 of housing 110. In one embodiment, rear panel 134 and transparent panel 132 together make up the entire top door 130 and cover upper opening 30. In one embodiment, as shown, for example, in FIG. 3, rear panel 134 may move with panel 132 such that rear panel 134 and panel 132 open when top door 130 is opened. In one embodiment, rear panel 134 may be fixed such that rear panel 134 does not open or move when top door 130 is opened and the top surface of fixed rear panel 134 may be used to place ambient products, like bottles and snack packets. As shown in FIG. 3, for example, in one embodiment, hinge assembly 150 may operate such that, based on the height of the cooler, top door 130 may be opened to an angle Θ of about 60 degrees to about 90 degrees between rear panel 134 and top surface 116 of housing 110. This may facilitate access to products within product compartment 114. In some embodiments, top door 130 may include a lock for preventing access to product compartment 114 through the door. Rear panel 134 may be transparent or opaque.

Vertical door 140 is coupled to housing 110 and is configured to cover a vertical opening 40 formed in front face 118 of cooler 100. In embodiments, vertical door 140 includes a transparent panel 142. In embodiments, vertical door 140 is substantially perpendicular to the floor and all shelves within product compartment 114 are substantially parallel to the floor, as shown, for example, in FIG. 2. In this manner, the plane of horizontal opening 30 and the plane of vertical opening 40 are also substantially perpendicular. In some embodiments, vertical door 140 may include a lock for preventing access to product compartment 114 through the door. In embodiments, vertical door 140 is a full length door covering the entire front face 118 of cooler 100.

Figure 5:
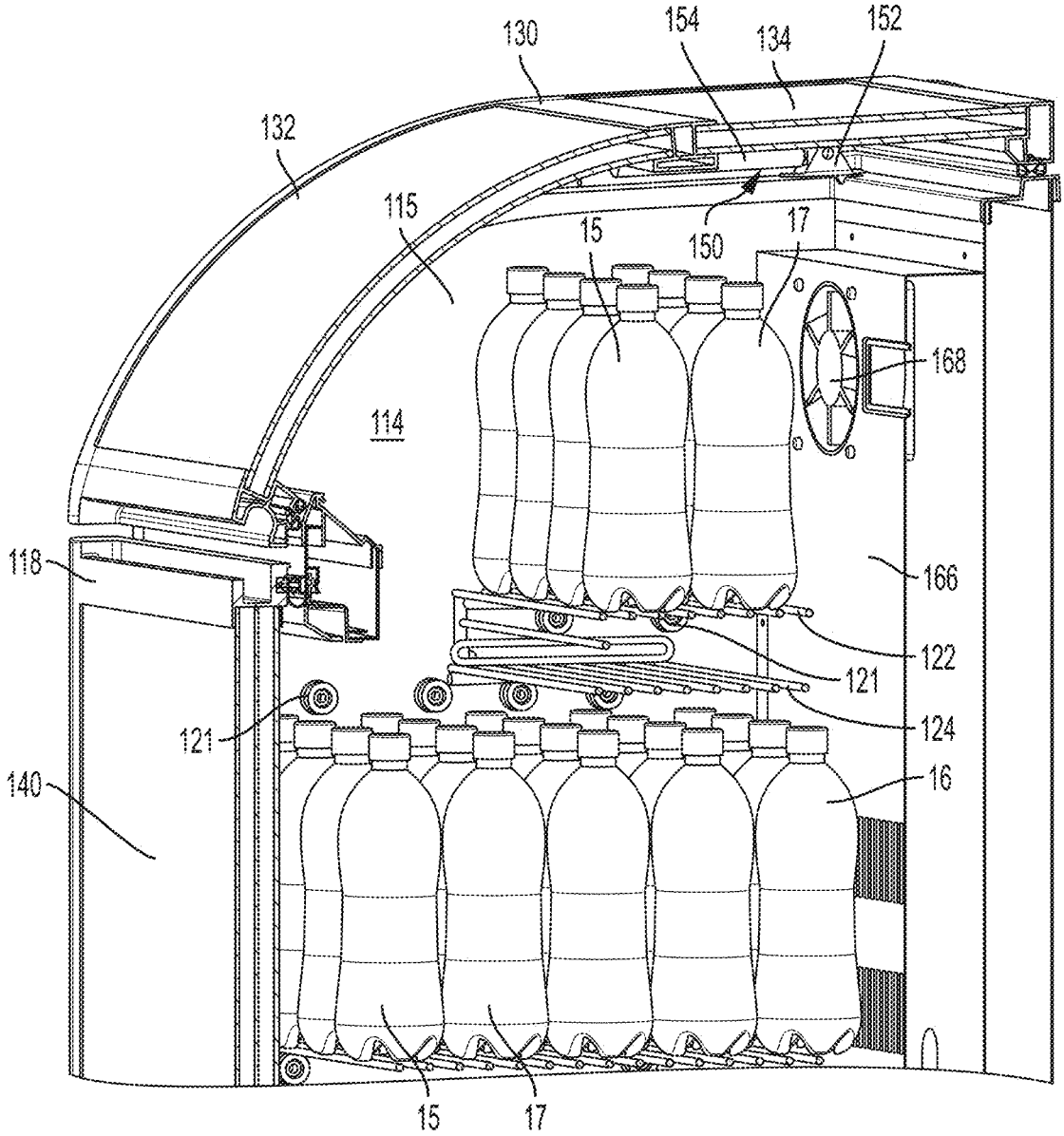
FIG. 5 is a partial cross-sectional perspective view of a cooler having a collapsible shelf according to embodiments.
Figure 6:
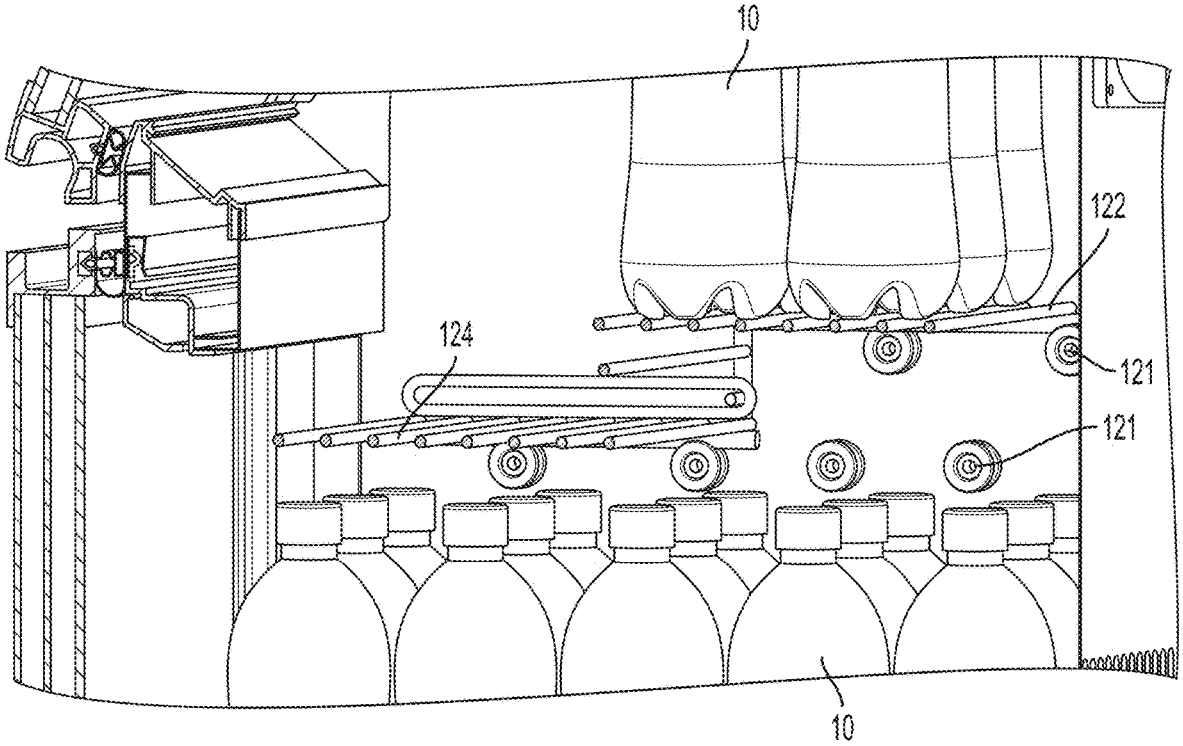
FIG. 6 is a partial cross-sectional perspective view of a cooler having a collapsible shelf according to embodiments.
Figure 7:
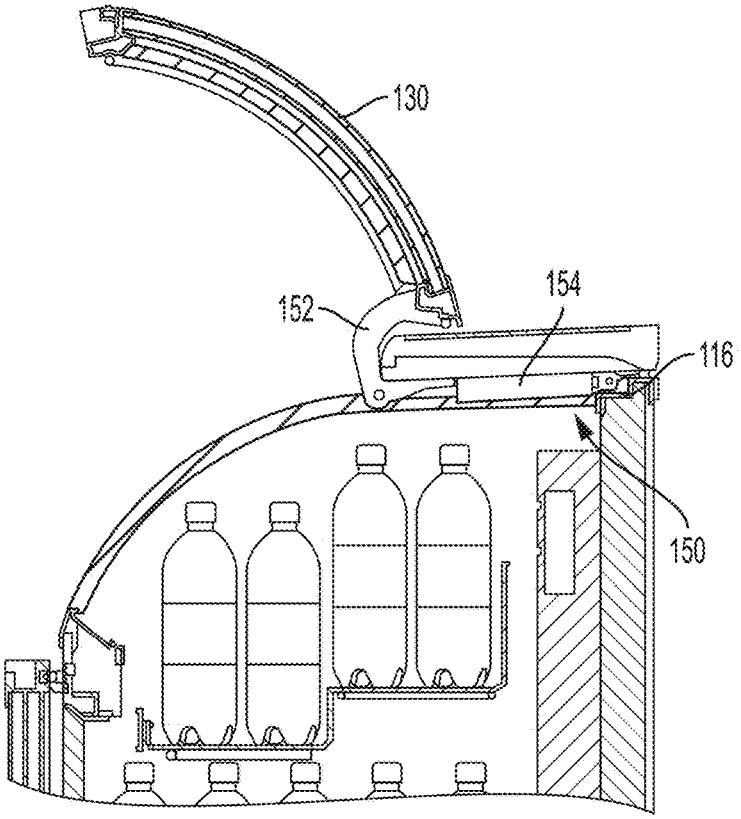
FIG. 7 is a partial cross-sectional perspective view of a cooler according to embodiments.

Cooler 100 includes a plurality of shelves for storing and displaying products 10 in product compartment 114. In embodiments, cooler 100 includes a collapsible shelf 120 comprising an upper step 122 and a lower step 124. In one embodiment, collapsible shelf 120 is the uppermost shelf in cooler 100. One or more lower shelves 126 are disposed below collapsible shelf 120. Products 15 may be disposed in a first row and products 17 may be disposed in a second or rearward row on a given shelf. Collapsible shelf 120 is configured to move between an extended position in which lower step 124 extends away from upper step 122, and a retracted position in which lower step 124 is retracted and disposed directly below upper step 122. In embodiments, as shown, for example, in FIGS. 5 and 6, cooler 100 may include rollers 121 coupled to interior wall 115. At least one of lower step 124 and upper step 122 may be disposed on rollers 121 to facilitate movement of lower step 124 relative to upper step 122. In embodiments, upper step 122 may move relative to lower step 124. Rollers 121 may be disposed along the length of lower step 124 and upper step 122.

In embodiments, products 12 disposed on upper step 122 and products 14 disposed on lower step 124 are visible through top door 130 including transparent panel 132, as shown, for example, in FIG. 1. In embodiments, products 12 disposed on upper step 122 and products 14 disposed on lower step 124 are visible through top door 130 including transparent panel 132, and products 16 disposed on lower shelf 126 are visible through vertical door 140 including transparent panel 142, as shown, for example, in FIG. 1. The increased visibility of products 10 disposed in product compartment, including products disposed in a first row and a rearward row of the cooler 100, may facilitate consumer awareness and purchase. The interior of housing 110 may include lighting, such as, for example, LED lighting that is arranged, for example on a door mullion, in such a way that both products 12 and 14 disposed on collapsible shelf 120 and products 16 disposed on lower shelf 126 are illuminated clearly.

Figure 4:
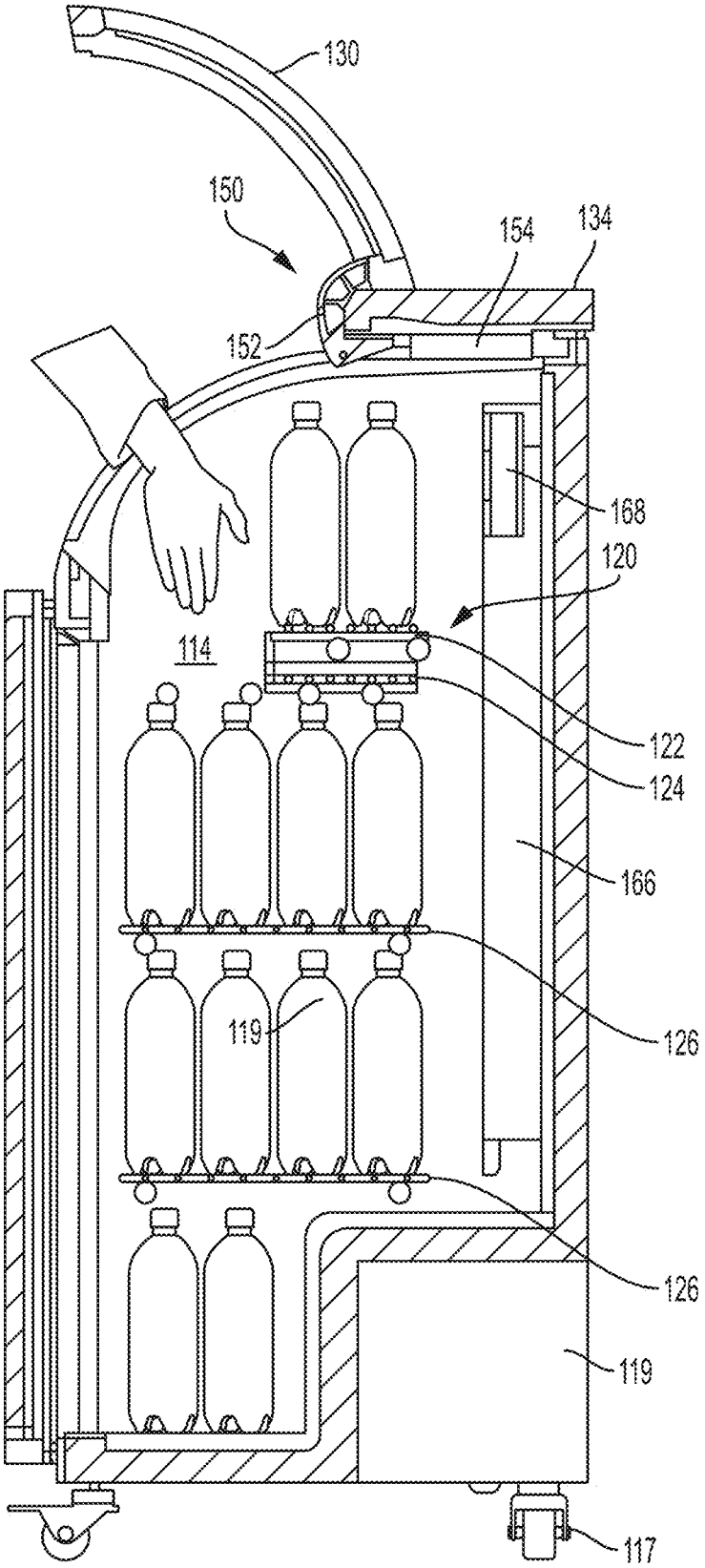
FIG. 4 illustrates a consumer accessing products stored in a cooler according to embodiments.

In embodiments, collapsible shelf 120 facilitates access to products disposed within product compartment 114. With reference to FIG. 4, when lower step 124 is in the retracted position, a user may more conveniently access products disposed in product compartment 114. For example, when lower step 124 is in the retracted position, a user may access products 16 disposed on lower shelf 126 through top door 130. This may provide additional convenience to the operator (e.g., user or shop owner) based on consumer demand, such as in cases where products disposed in cooler 100 include seasonal products. For example, during times of lower consumer demand (e.g., during winter months), collapsible shelf 120 may be provided in the extended position and products may be disposed on upper step 122 and lower step 124. At the same time, an operator (e.g., shop owner) may choose to not store products in product compartment 114 below collapsible shelf 120. The operator may choose to lock vertical door 140 such that consumers may only access products in cooler 100 via top door 130. In this manner, when demand is low and fewer products are needed, the cooling capability of the cooler 100 may be efficiently maintained and the overall energy consumption reduced. Also, the storing and use capacity of cooler 100 may be flexible.

In this manner, a user may access products 10 disposed in two separate areas of the product compartment through the same door. For example, a user may access products disposed in an upper portion of product compartment 114 (products disposed above collapsible shelf 120) and products disposed in a lower portion of product compartment 114 (products disposed below collapsible shelf 120) through top door 130. In embodiments, a user may simultaneously access products in the lower portion of product compartment 114 through a separate access, i.e., vertical door 140.

A cooling unit 160 for cooling and maintaining the temperature of product compartment 114 is disposed in housing 110. Cooling unit 160 may be, for example, a refrigeration system. Cooling unit 160 may be disposed partially or entirely within housing 110. Cooling unit 160 includes a compressor 162, an internal condenser 164, an evaporator 166, and a fan 168 that are operatively connected to generate and distribute cool air within product compartment 114. In one embodiment, as shown in FIG. 2, for example, evaporator 166 is disposed within housing 110. In one embodiment, compressor 162 and condenser 164 are disposed below the lower shelf 126 where lower shelf 126 is the lowermost shelf in product compartment 114. For example, in one embodiment, compressor 162 and condenser 164 are disposed in a cavity 119 formed in housing 110. Cavity 119 may be in a rear portion of product compartment 114 below lower shelf 126 such that products 10 may be positioned within cooler 100 in front of cavity 119, as shown, for example, in FIG. 2. In other embodiments, condenser 164 may be disposed externally, such as, for example, on an outer rear face of housing 110.

Figure 10:
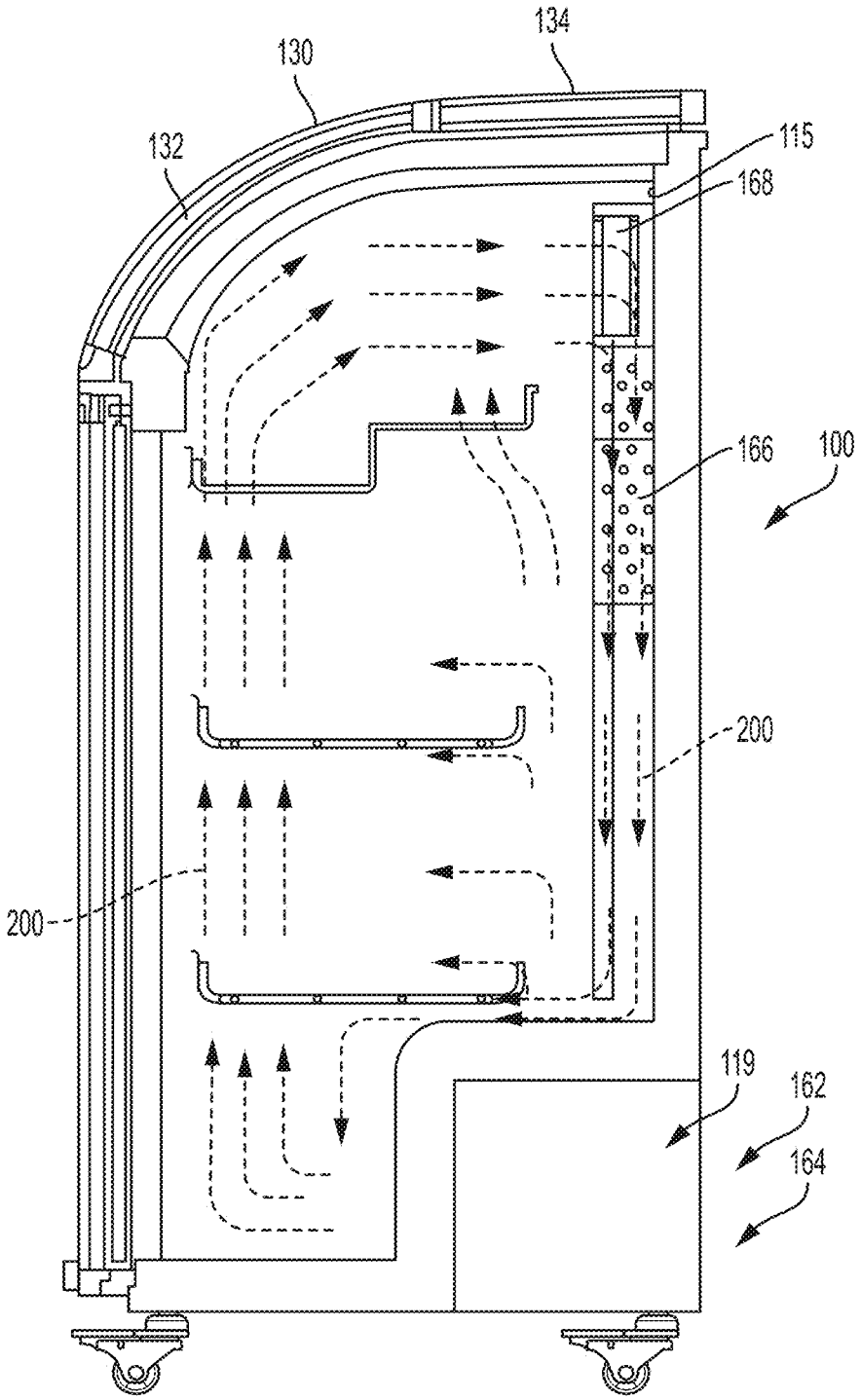
FIG. 10 is a schematic illustration of air flow in a cooler according to embodiments.
Figure 11:
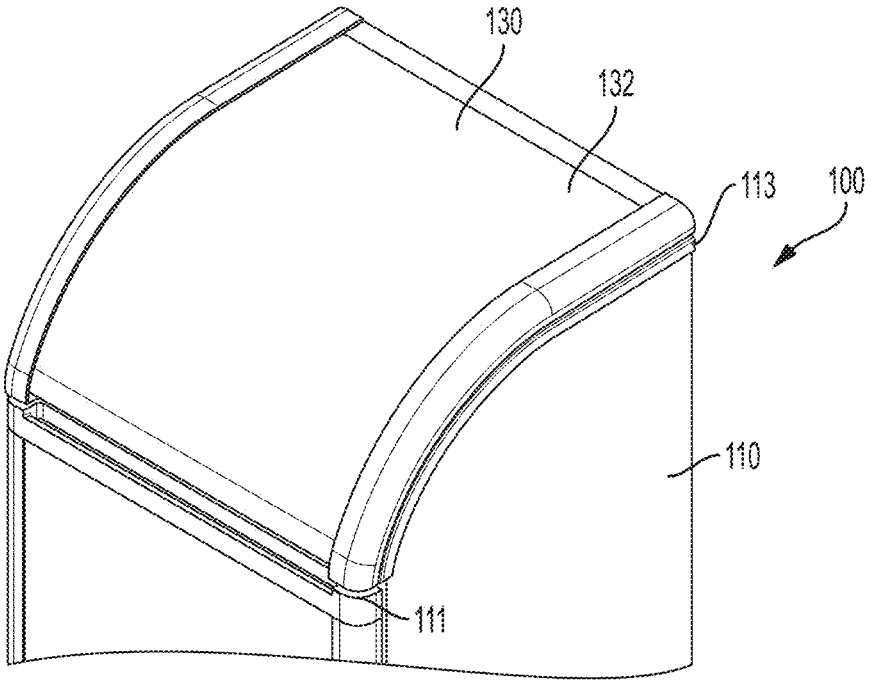
FIG. 11 is a top perspective view of a cooler top door according to embodiments.
Figure 12:
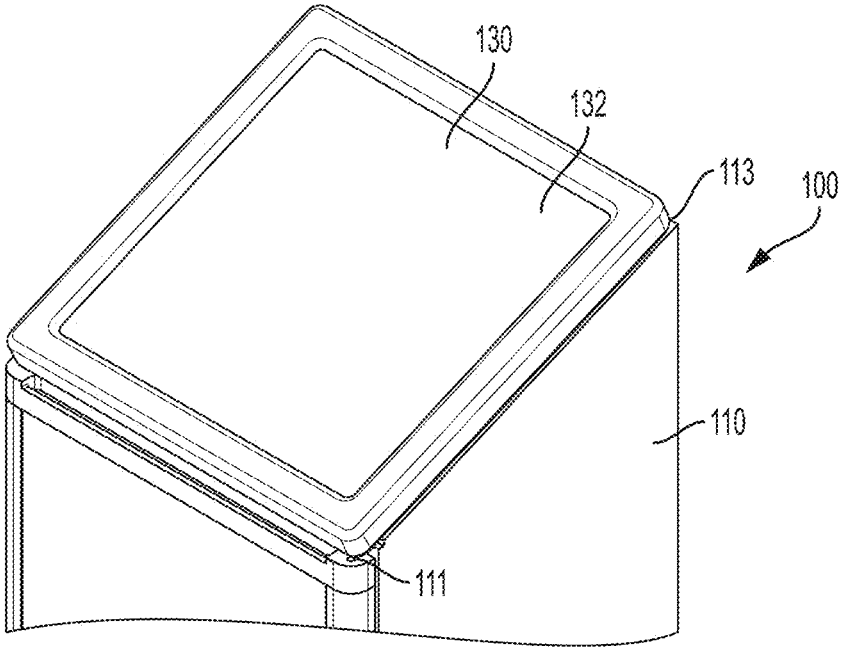
FIG. 12 is a top perspective view of a cooler top door according to embodiments.
Figure 13:
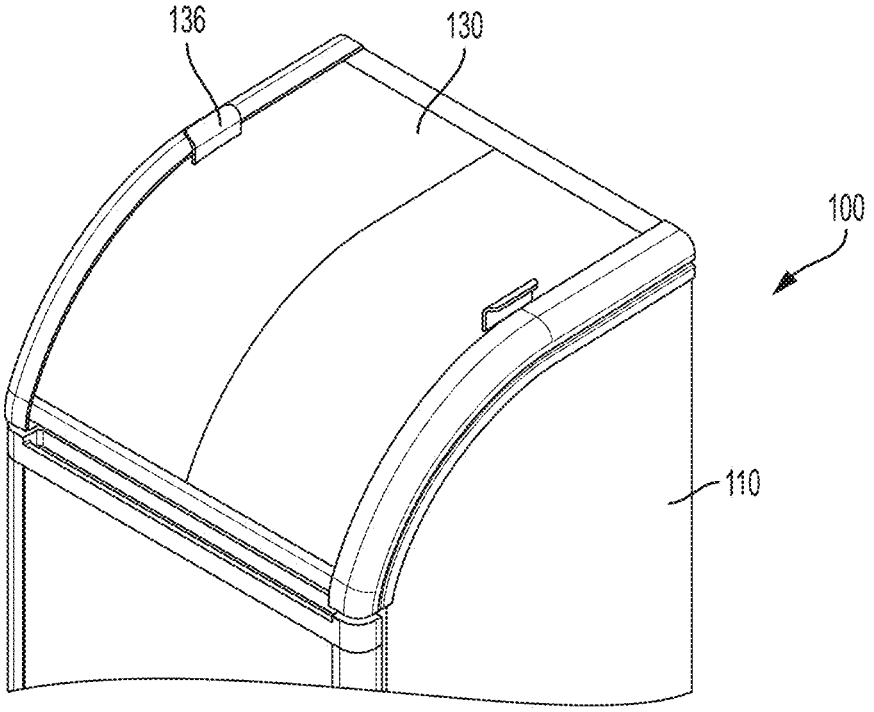
FIG. 13 is a top perspective view of a cooler top door according to embodiments.
Figure 14:
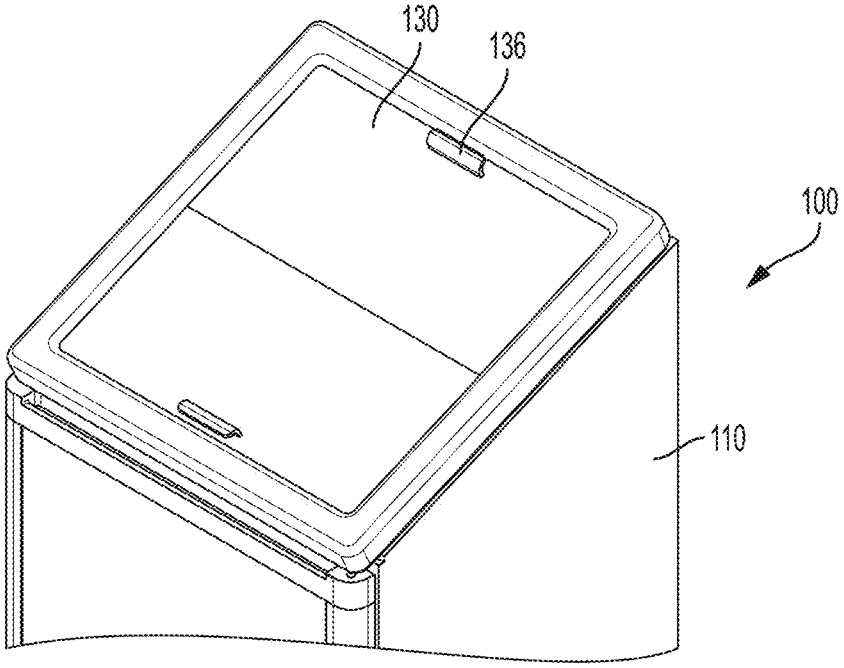
FIG. 14 is a top perspective view of a cooler top door according to embodiments.
Figure 15:
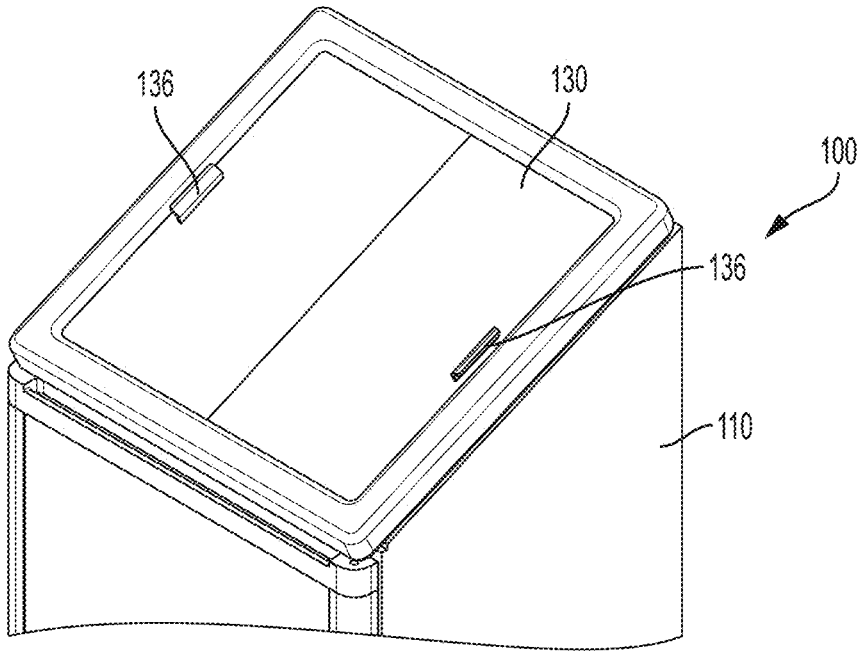
FIG. 15 is a top perspective view of a cooler top door according to embodiments.
Figure 16:
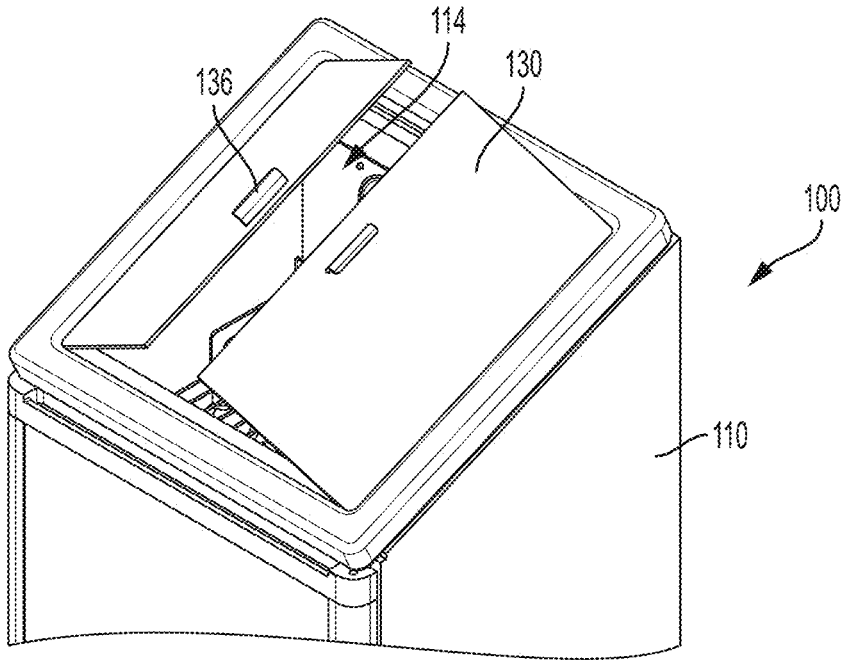
FIG. 16 is a top perspective view of a cooler top door according to embodiments.
Figure 17:
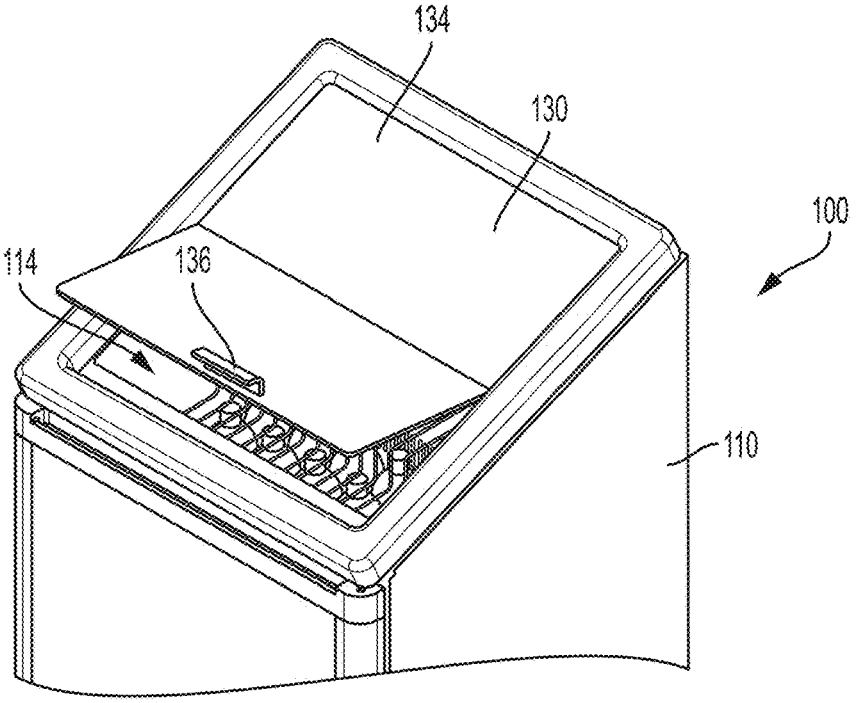
FIG. 17 is a top perspective view of a cooler top door according to embodiments.
Figure 18:
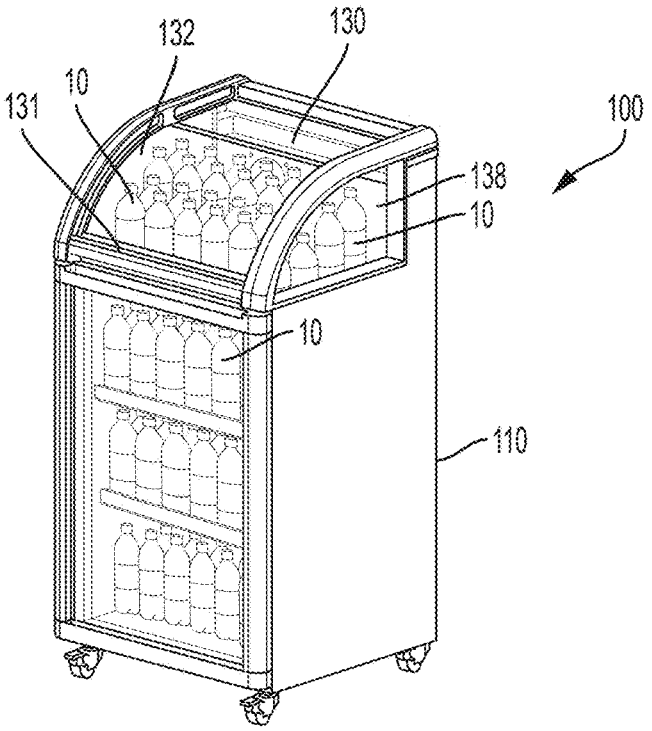
FIG. 18 is a front perspective view of a cooler top door according to embodiments.
Figure 19:
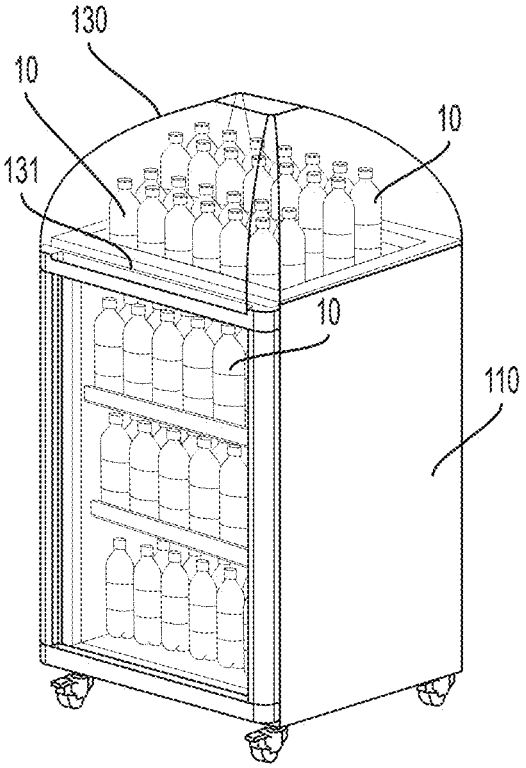
FIG. 19 is a front perspective view of a cooler top door according to embodiments.

With reference to FIG. 10, in embodiments cooler 100 is configured to facilitate increased air flow, schematically illustrated with arrows 200. Specifically, top door 130 and collapsible shelf 120 may be configured to facilitate increased air flow within the product compartment 114, which may result in improved air distribution and uniform cooling within the cooler. As shown in FIG. 10, for example, air from cooling unit 160 may be blown into product compartment 114 at fan 168 such that the air travels along a rear interior wall 115 of the cooler, including evaporator 166. The product compartment 114 is configured such that the air deflects off a top surface of cavity 119 and the floor of product compartment 114 and then travels within the compartment. When air flow reaches panel 132 of top door 130, particularly in embodiments in which panel 132 is curved, the air deflects such that it simultaneously reaches products 14 on lower step 124 and products 12 disposed on upper step 122, as well as products 15 disposed in a first row and products 17 disposed in a second or rearward row on a given shelf With reference to FIGS. 11-18, further embodiments of top door 130 will be described. Embodiments of top door 130 may be used in conjunction with any one or more of the features described herein. In embodiments, top door 130 comprises a single full length panel 132 extending from a front edge 111 of housing 110 to a rear edge 113 of housing 110, as shown, for example, in FIG. 11. In embodiments, top door 130 comprises a single flat panel 132 that is angled upward from a front edge 111 of housing 110 to a rear edge 113 of housing 110, as shown, for example, in FIG. 12. In embodiments, top door 130 comprises two curved doors that may be opened by sliding the doors leftward or rightward, respectively, toward the center of top door 130, as shown, for example, in FIG. 13. In embodiments, top door 130 comprises two flat doors that may be opened by sliding the doors upward or downward, respectively, toward the center of top door 130, as shown, for example, in FIG. 14. In embodiments, top door 130 comprises two flat doors that may be opened by sliding the doors leftward or rightward, respectively, toward the center of top door 130, as shown, for example, in FIG. 15. In embodiments, top door 130 comprises two flat, hinged doors that may be opened as shown, for example, in FIG. 16. In embodiments, top door 130 comprises a fixed rear panel 134 and a hinged front door, as shown, for example, in FIG. 17. In embodiments, top door 130 comprises a full length transparent panel 132 and transparent side panels 138, as shown, for example, in FIG. 18. In embodiments, top door 130 is a transparent full bowl shaped cover with curved panels on each side of cooler 100, as shown, for example, in FIG. 19. This may facilitate product visibility from all sides of cooler 100. In embodiments, top door 130, or portions thereof, may comprise a transparent panel such that products within cooler 100 may be visible.

Figure 20:
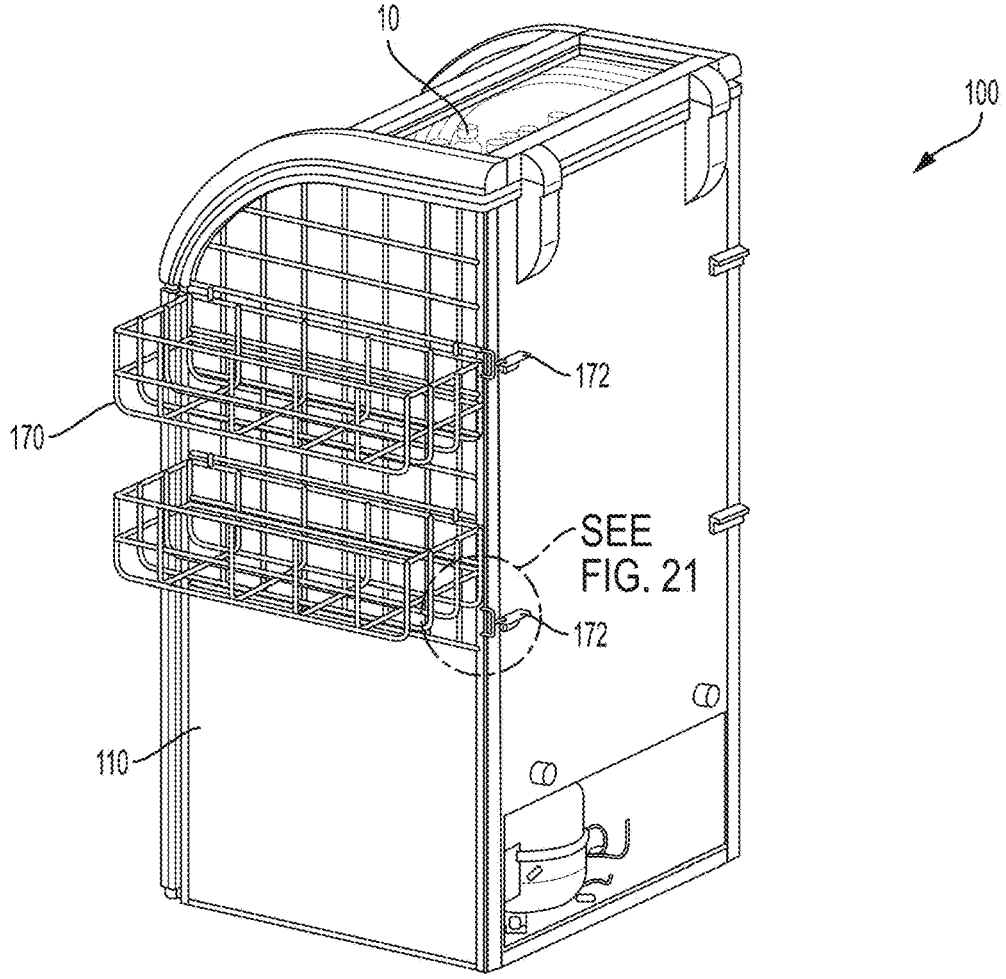
FIG. 20 is a perspective view of a cooler with external storage according to embodiments.
Figure 21:
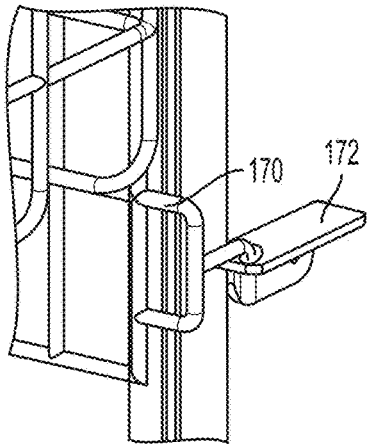
FIG. 21 is an enlarged partial perspective of a cooler with external storage according to embodiments.

In embodiments, cooler 100 may include external storage 170 for storing and displaying products 10 outside cooler housing 110. In embodiments, as shown, for example, in FIGS. 20 and 21, external storage 170 may comprise one or more baskets 170 that may be mounted on cooler housing 110 at mounting members 172. Mounting members 172 may include brackets fixed to housing 110 and apertures for receiving a portion of baskets 170. External storage 170 may be modular and may be efficiently added and removed from housing 110.

It is to be appreciated that the Detailed Description section, and not the Summary and Abstract sections, is intended to be used to interpret the claims. The Summary and Abstract sections may set forth one or more but not all exemplary embodiments of the present invention(s) as contemplated by the inventor(s), and thus, are not intended to limit the present invention(s) and the appended claims in any way.

The present invention(s) have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention(s) that others can, by applying knowledge within the skill of the art, readily modify and/or adapt for various applications such specific embodiments, without undue experimentation, without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention(s) should not be limited by any of the above-described exemplary embodiments, but should be defined only in accordance with the following claims and their equivalents.

What is claimed is:

1. A cooler for dispensing products, comprising:

a housing defining a product compartment having a front end opposite a rear end;

a top door coupled to a top surface of the housing at a hinge, the top door comprising a rear panel fixed to a curved transparent panel, wherein the hinge is connected to a rearmost end of the housing and to the rear panel of the top door, and a pneumatic cylinder coupled to the top surface of the housing at a location forward of the hinge and to the rear panel such that both the rear panel and the curved transparent panel of the top door are configured to move to an open position when the top door is rotated about the hinge;

a vertical door coupled to a vertical front surface of the housing;

a collapsible shelf disposed in the product compartment wherein the collapsible shelf comprises an upper step and a lower step that is configured to move between an extended position and a retracted position, wherein the upper step remains in the same position as the lower step moves between the extended position and the retracted position; and a lower shelf disposed below the collapsible shelf in the product compartment, wherein the collapsible shelf is configured such that a product disposed on the lower step of the collapsible shelf is accessible through the top door when the lower step of the collapsible shelf is in the extended position and a product disposed on the lower shelf is accessible through the top door when the lower step of the collapsible shelf is in the retracted position, wherein the lower shelf has a first length and extends from the rear end to the front end of the product compartment, wherein each of the upper step and the lower step of the collapsible shelf has a length less than the first length, wherein in the retracted position the collapsible shelf extends from the rear end to a point between the rear end and the front end, and wherein in the extended position the collapsible shelf has approximately the first length and extends from the rear end to the front end of the product compartment.

2. The cooler of claim 1, wherein the hinge comprises a gas spring hinge.

3. The cooler of claim 1, wherein the curved transparent panel is a multi-pane glass panel.

4. The cooler of claim 1, wherein the top door extends from a front most edge of the housing to the rearmost end of the housing.

5. The cooler of claim 1, wherein the vertical door comprises a transparent panel.

6. The cooler of claim 1, wherein the collapsible shelf is configured to support a product in the extended position and the retracted position.

7. The cooler of claim 1, wherein the vertical door comprises a transparent panel, and wherein the transparent panel of the vertical door and the curved transparent panel are configured such that a product disposed on the upper step, a product disposed on the lower step, and a product disposed on the lower shelf are visible to a consumer positioned in front of the cooler.

8. A cooler for dispensing products, comprising:

a frame;

a housing disposed around the frame and having a front end opposite a rearmost end, the housing defining a single product compartment and comprising a top opening in a top surface of the housing and a vertical opening in a front surface of the housing;

a top door disposed over the top opening and extending from the front end to the rearmost end of the housing, the top door comprising a horizontal surface and a curved transparent panel, the top door coupled to the housing via a hinge assembly such that the top door is configured to move between an open position allowing access to the product compartment and a closed position, wherein the hinge assembly comprises:

a hinge coupled to the horizontal surface of the top door and to the rearmost end of the housing; and a pneumatic cylinder coupled to the top surface of the housing at a location forward of the hinge and to the horizontal surface of the top door, such that both the horizontal surface and the curved transparent panel of the top door are configured to move to the open position;

a vertical door disposed over the vertical opening configured to move between an open position allowing access to the product compartment and a closed position;

an uppermost shelf comprising an upper step and a lower step, wherein the lower step is configured to move between an extended position in which the lower step extends forwardly and away from the upper step and a retracted position in which the lower step is disposed directly below the upper step, wherein the lower step remains within the product compartment as the lower step moves between the extended position and the retracted position; and a lower shelf disposed below the uppermost shelf.

9. The cooler of claim 8, wherein in the top door open position the angle between the horizontal surface of the top door and the housing top surface is from about 60 degrees to about 90 degrees.

10. The cooler of claim 8, further comprising a refrigeration unit disposed below the lower shelf.

11. The cooler of claim 8, wherein the curved transparent panel is a multi-pane glass panel.

12. The cooler of claim 8, wherein the vertical door comprises a transparent panel, and wherein the vertical door transparent panel and the curved transparent panel are configured such that a product disposed on the upper step, a product disposed on the lower step, and a product disposed on the lower shelf are visible to a consumer positioned in front of the cooler.

13. The cooler of claim 8, further comprising a storage basket coupled to an external surface of the housing.

14. The cooler of claim 8, wherein the hinge comprises a gas spring hinge.

15. A cooler for dispensing products, comprising:

a frame;

a housing disposed around the frame, the housing defining a product compartment and comprising a top opening in a top surface of the housing and a vertical opening in a front surface of the housing;

a top door comprising a rear panel fixed to a transparent panel, the top door disposed over the top opening;

a hinge connected to a rearmost end of the housing and to the rear panel of the top door, and a pneumatic cylinder coupled to the top surface of the housing at a location forward of the hinge and to the rear panel such that both the rear panel and the curved transparent panel of the top door are configured to move to an open position when the top door is rotated about the hinge;

a vertical door disposed over the vertical opening;

an uppermost shelf arranged at an upper end of the housing so as to define an upper portion of the product compartment above the uppermost shelf that is accessible via the top door, and a lower portion of the product compartment below the uppermost shelf that is accessible via the vertical door, the uppermost shelf comprising an upper step and a lower step, wherein the lower step is configured to move between an extended position in which only the upper portion of the product compartment is accessible via the top door, and a retracted position in which the lower step is disposed directly below the upper step and the upper portion and lower portion of the product compartment are accessible via the top door, and wherein the lower step remains within the product compartment as the lower step moves between the extended position and the retracted position; and a lower shelf disposed below the uppermost shelf configured to have a first row of products and a second row of products disposed on the lower shelf, wherein the top door and the uppermost shelf are configured to facilitate increased air flow within the product compartment.

16. The cooler of claim 15, wherein the top door comprises a characteristic selected from the group consisting of: a flat glass door, a curved door, a bowl shaped door, a hinged mechanism, and a sliding mechanism.

* * * * *